US007347636B2

(12) United States Patent
Jung

(10) Patent No.: US 7,347,636 B2
(45) Date of Patent: Mar. 25, 2008

(54) PRINTING CONTROL SYSTEM AND METHOD FOR AN INKJET PRINTER

(75) Inventor: Young-do Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 14 days.

(21) Appl. No.: 10/971,044

(22) Filed: Oct. 25, 2004

(65) Prior Publication Data

US 2005/0128227 A1 Jun. 16, 2005

(30) Foreign Application Priority Data

Dec. 11, 2003 (KR) ..... 2003-0090020

(51) Int. Cl.
*B41J 19/00* (2006.01)
*B41J 2/325* (2006.01)

(52) U.S. Cl. ..... 400/303; 400/283; 347/5; 347/16

(58) Field of Classification Search ..... 400/283, 400/303; 347/5, 16, 172–179, 213, 215–220
See application file for complete search history.

(56) References Cited

U.S. PATENT DOCUMENTS 5,189,436 A 2/1993 Yoshikawa
5,458,324 A * 10/1995 Nakamura et al. ..... 271/10.02
6,076,911 A * 6/2000 Watanabe ..... 347/16
2002/0080201 A1 6/2002 Li et al. ..... 347/9

FOREIGN PATENT DOCUMENTS

JP 01145173 * 6/1989
JP 11-198449 7/1999
JP 2001-310509 11/2001
KR 1998-078289 11/1998

* cited by examiner

*Primary Examiner*—Ren Yan
*Assistant Examiner*—Marissa Ferguson-Samreth
(74) *Attorney, Agent, or Firm*—Roylance, Abrams, Berdo and Goodman, LLP

(57) ABSTRACT

A printing control system and method for an inkjet printer, wherein a carrier equipped with one or more inkjet cartridges is driven while the line feeding is being executed, and the line printing is initiated after the line feeding of the paper is completed. The printing control method may comprise a number of steps to determine whether a line printing by the ink cartridges has been completed, and if so, executing the line feeding. The printing control method may further comprise estimating an expected length of time $T_E$ from a time point $T_C$ where the carrier initiates a next movement, to a time point $T_I$ where the next line printing is initiated, and comparing a length of feeding time $T_{RX}$ remaining until the line feeding is completed with the expected length of time $T_E$, and driving the carrier if the length of remaining feeding time $T_{RX}$ becomes less than or equal to the expected length of time $T_E$.

17 Claims, 9 Drawing Sheets

PRINTING CONTROL SYSTEM AND METHOD FOR AN INKJET PRINTER

PRIORITY

This application claims priority under 35 U.S.C. § 119(a) to an application entitled "Printing controlling method for inkjet printer", filed in the Korean Intellectual Property Office on Dec. 11, 2003 and assigned Ser. No. 2003-90020, the entire contents of which are incorporated herein by reference.

BACKGROUND OF THE INVENTION

1. Field of the Invention

The present invention relates to an inkjet printer. More particularly, the present invention relates to a printing control system and method for an inkjet printer that is provided to increase printing speed by substantially eliminating delays between feed and print operations.

2. Description of the Related Art

FIG. 1 shows a construction example of a conventional inkjet printer. Referring to FIG. 1, the conventional inkjet printer comprises ink cartridges 11 and 12, a carrier 20, a paper feeding tray 30, and a feeding roller 40.

The respective ink cartridges 11 and 12 contain an ink, and each comprises a print head (not shown) for ejecting the ink contained therein. The carrier 20 carries the ink cartridges 11 and 12 while reciprocating a predetermined distance along a guide bar 55 installed in the printer body 50, so that the ink cartridges 11 and 12 can perform a line printing on a paper P (shown in outline only). The paper feeding tray 30 is loaded with papers (not shown), and the feeding roller 40 moves a paper P loaded in the paper feeding tray 30 to a printing area beneath the ink cartridges 11 and 12.

The conventional inkjet printer constructed as described above receives printing commands and feeding commands from a host, and a controller controls the driving of the carrier 20 and the feeding roller 40 according to respective commands, so that printing is executed on the paper P. Specifically, a paper P fed from the paper feeding tray 30 is delivered by the feeding roller 40 and stops at a printing position. At this time, the carrier 20 drives the ink cartridges 11 and 12 to pass over the paper P, and the ink cartridges 11 and 12 eject ink, so that a line of printing is performed on the paper P. Then, as the carrier 20 goes beyond the paper P and stops at the opposite side of the paper, the feeding roller 40 performs so-called "line feeding", in which the feeding roller moves the paper P by a predetermined distance according to a feeding command. After the paper P is stopped, the carrier 20 is driven according to a next printing command and the ink is again ejected onto the paper P. As the line feeding of the paper P and the reciprocation of the carrier 20 are repeated in this manner, one printed page is completed on the paper P.

With the conventional inkjet printer example as described above, the carrier 20 starts to move after a line feeding of a paper P is completed, as shown in FIG. 2. In FIG. 2, the travel period and velocity of the carrier 20 is shown, defining a first and second printing, and a travel period and velocity of the feeding roller 40 is shown, defining a paper line feed, wherein the V-axis represents velocity and the T-axis represents time. However, a printing area, such as $D_I$ where the ink is substantially ejected onto the paper P, does not coincide with a time point $T_C$ where the feeding roller 40 stops and the carrier 20 starts to move. An actual line printing on a paper P therefore, is delayed for a predetermined time length after a line feeding of a paper P is completed.

As a result, a line printing cannot be initiated right after a line feeding of a paper P is completed, thereby causing a time delay. Therefore, a printing speed of an inkjet printer is reduced.

Accordingly, a need exists for a printing control method for an inkjet printer that can substantially increase printing speeds by reducing the time delays experienced by a printer between a time where a line feeding of a paper is completed, and a time where a line printing is initiated.

SUMMARY OF THE INVENTION

It is therefore an object of the present invention to solve at least the above problems and disadvantages, and to provide at least the advantages described below. Accordingly, an object of the present invention is to provide a printing control system and method for an inkjet printer that can increase printing speed by reducing a time delay between a time point where a line feeding of a paper is completed, and a time point where a line printing is initiated.

In order to achieve the above-described aspects of the present invention, a printing control system and method for an inkjet printer is provided wherein a carrier equipped with one or more inkjet cartridges is adapted to be driven while a line feeding is being executed. A line printing by the ink cartridges is then initiated after a line feeding of the paper is completed.

According to an embodiment of the present invention, the printing control method may comprise the steps of determining whether the line printing by the ink cartridges has been completed or not; initiating the line feeding if it is determined that the line printing has been completed; during line feeding, estimating an expected length of time $T_E$ from a time point $T_C$ where the carrier initiates a next movement, to a time point $T_I$ where the next line printing is initiated; comparing a length of line feeding time $T_{RX}$ remaining until the line feeding is completed, with the expected length of time $T_E$; and driving the carrier if it is determined that the remaining feeding time $T_{RX}$ is less than or equal to the expected length of time $T_E$. In doing so, the carrier 20 can be approaching a point at which printing occurs, while the feed roller 40 is completing a line feed.

In the step of comparing the time $T_{RX}$ with the time $T_E$, the time $T_{RX}$ can be reduced to an interval of predetermined time $\Delta T$ to then be compared with the time $T_E$.

According to an embodiment of the present invention, the moving velocity of the carrier is varied, and divided into an acceleration section, a constant-velocity section, and a deceleration section. The acceleration section may be further divided into several unit acceleration sections. Here, if the time $T_I$ is positioned in the acceleration section, the expected length of time $T_E$ can be determined as a length of time from the time $T_C$ to a time point where a corresponding unit acceleration section is initiated.

In addition, the several unit acceleration sections are preferably formed by dividing the length of time from the time $T_I$, to a time point $T_K$ where the constant-velocity section is initiated, by a predetermined time interval.

Furthermore, the printing control method may further comprise the steps of: determining whether the line feeding of the paper has been completed at a time point where the next line printing is initiated; and displaying an error message if the line printing is initiated in a state where the line feeding of the paper has not been completed.

In a preferred embodiment of the present invention, the line feeding of the paper for the next line printing is initiated concurrently when the line printing is completed.

BRIEF DESCRIPTION OF THE DRAWINGS

The above objects and other features of embodiments of the present invention will become more apparent by describing certain exemplary embodiments thereof with reference to the attached drawings, wherein.

DETAILED DESCRIPTION OF THE EXEMPLARY EMBODIMENTS

Figure 1:
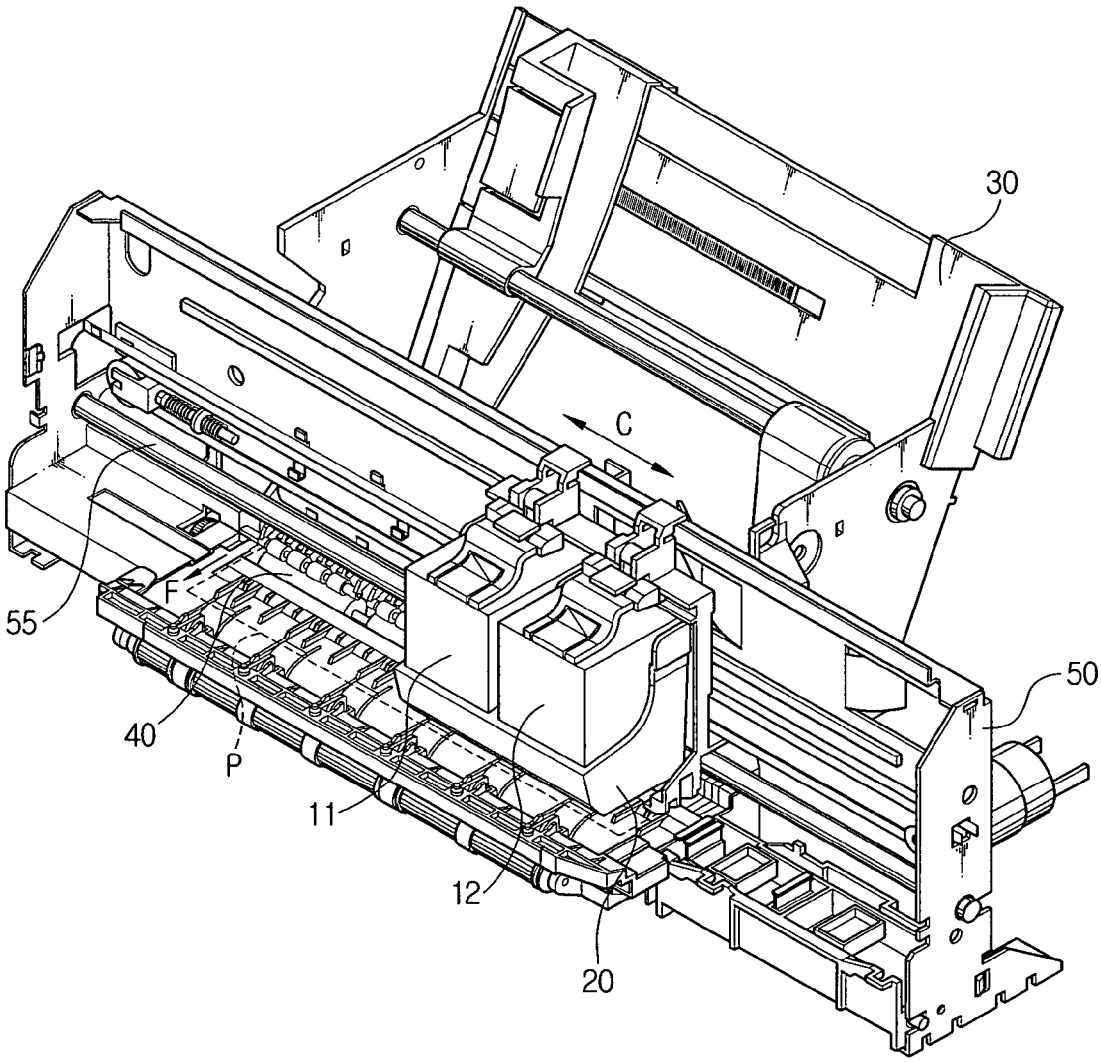
FIG. 1 (PRIOR ART)
FIG. 1 is a perspective view illustrating a construction example of part of a conventional inkjet printer.
Figure 2:
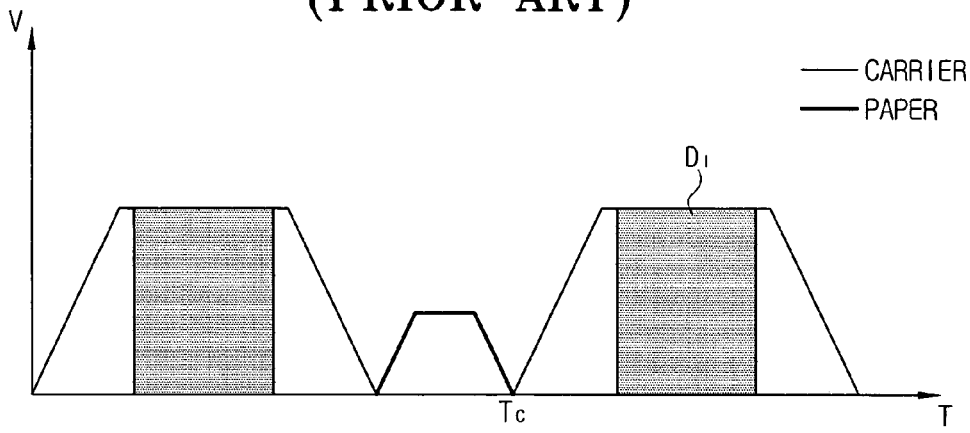
FIG. 2 (PRIOR ART)
FIG. 2 is a graph showing a relationship between a carrier movement and a paper feeding movement in a conventional inkjet printer.

Hereinbelow, an example printing control system and method for an inkjet printer according to certain embodiments of the present invention will be described in detail with reference to the accompanying drawings. Further, in referring to the elements having the same structure and operation, the elements will be cited by the same reference numerals throughout.

Figure 3:
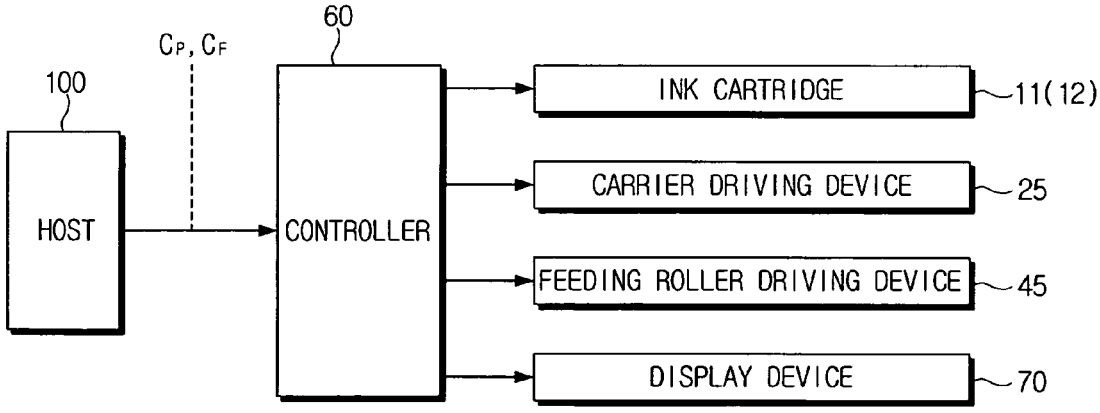
FIG. 3 is a block diagram illustrating a construction example of a printer including a printing control method according to an embodiment of the present invention.

An inkjet printer, to which the printing control system and method is applied according to an embodiment of the present invention, has a construction similar to the conventional printer shown in FIG. 1. The inkjet printer comprises ink cartridges 11 and 12, a carrier 20, a paper feeding tray 30, a feeding roller 40, a controller 60, a carrier driving device 25, a feeding roller driving device 45 and a display device 70, as shown in FIGS. 1 and 3.

The ink cartridges 11 and 12 are provided with print heads (not shown), respectively, and are removably mounted in the carrier 20. In this example, one of the ink cartridges 11 and 12 is a black-and-white ink cartridge for black-and-white printing, and the other one is a color cartridge for color printing. However, the present invention can also be applied to an inkjet printer equipped with only one of the black-and-white ink cartridge or the color ink cartridge, or any additional cartridge combinations as required.

The carrier 20 is installed to reciprocate along a guide bar 55 provided in the printer body 50. As a line feeding is performed over a predetermined distance, such that a paper P fed from the paper feeding tray 30 is moved to a printing position, the carrier 20 moves in the printing direction C along the guide bar 55. At this time, the ink cartridges 11 and 12 eject the ink onto the paper P, thereby executing a line printing. Such movement of the carrier 20 and the line printing are repeated until one page printing of the paper P is completed.

The controller 60 controls the movement of the carrier 20 and the line feeding of the paper P. As shown in FIG. 3, if the inkjet printer receives a printing command $C_P$ and a feeding command $C_F$ from a host 100, the controller 60 controls the carrier driving device 25 and the feeding roller driving device 45 based on the commands. In this example, each of the carrier driving device 25 and the feeding roller driving device 45 may employ a number of drive motors, such as a DC motor or a step motor.

In addition, a display device 70 is connected to the controller 60, and any errors detected during the printing operation and/or conditions of the inkjet printer may be displayed through the display device 70.

The inkjet printer has various printing modes according to the desired printing qualities of printout products. The printing modes of an inkjet printer may include a high speed printing mode, a normal printing mode, a high quality printing mode, a best quality printing mode, or other printing modes, and the moving velocity of the carrier 20 (FIG. 1), and the line feeding distance of a paper, $D_F$ (FIG. 5A), can be varied according to the respective printing modes.

FIGS. 4A to 4H are graphs illustrating relationships between carrier movement and paper line feeding movement according to various printing modes of an inkjet printer in accordance with an embodiment of the present invention. In the graphs, the travel period and velocity of the carrier 20 is shown, defining a first and second printing, and a travel period and velocity of the feeding roller 40 is shown, defining a paper line feed, wherein the V-axis represents velocity and the T-axis represents time. As can be seen from the illustrated graphs, in the moving distance $D_C$ over which the carrier 20 (FIG. 1) is reciprocated, the moving velocity of the carrier 20 is varied, first exhibiting an acceleration section $V_U$, then a constant-velocity section $V_P$, and finally a deceleration section $V_D$. The feeding velocity of a paper P also exhibits variations, including a period of acceleration, constant-velocity and deceleration. Typically, in a high speed printing mode (FIGS. 4A, 4C, 4E, 4G), the constant-velocity section $V_P$ of the moving velocity of the carrier 20 appears as a maximum velocity $V_M$, and in a non-high speed printing mode (FIGS. 4B, 4D, 4F, 4H), the constant-velocity section $V_P$ of the moving velocity of the carrier 20 appears as a normal velocity $V_N$. The distance $D_C$ in FIG. 4A indicates a distance that the carrier 20 moves at one time, and distance $D_I$ indicates the area where line printing is actually performed in the moving distance $D_C$ of the carrier 20.

The line feeding of a paper P can be established having several patterns of line feeding distances $D_F$, and executed in a predetermined pattern according to a desired printing mode. In addition, as shown in FIGS. 4A to 4H, a line feeding of a paper P can be initiated concurrently with the completion of a line printing so that a time delay is not produced in the printing operation. The time point where a line printing is completed can be easily found by detecting a time point where the ink ejection of the cartridges 11 and 12 (FIG. 1) is completed.

Figure 4A:
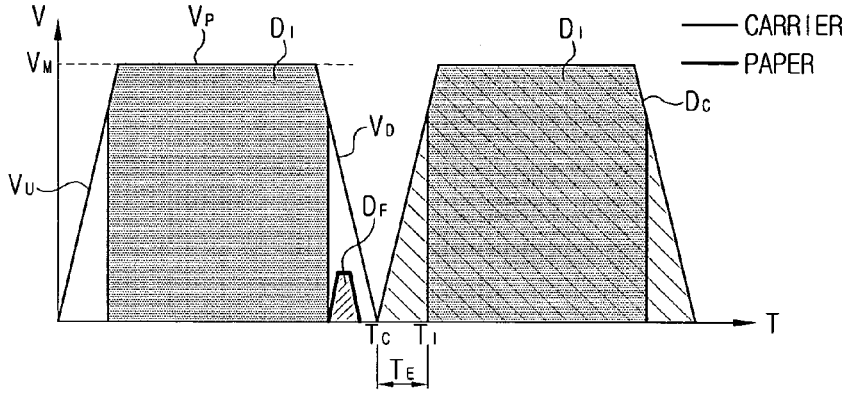
FIGS. 4A to 4H are graphs showing the relationships between the movement of the carrier and paper feeding movements as controlled by the printing control method according to an embodiment of the present invention.
Figure 4B:
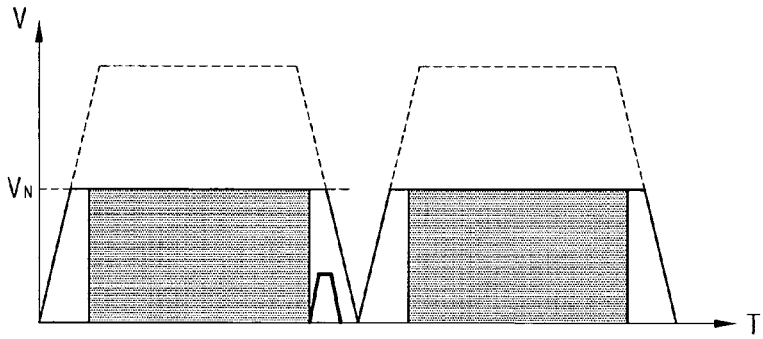
Figure 4C:
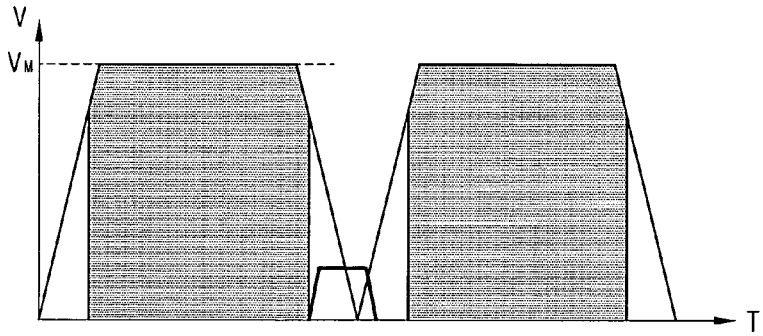
Figure 4D:
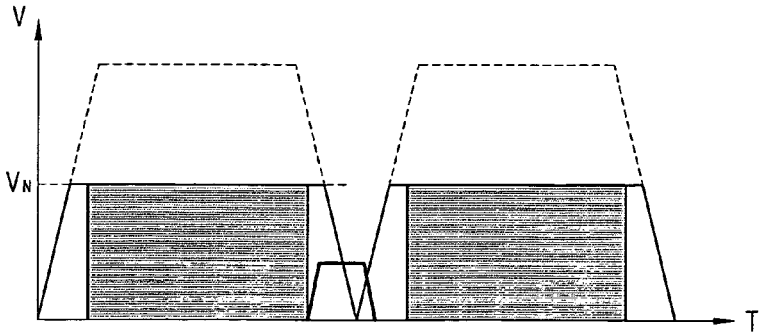
Figure 4E:
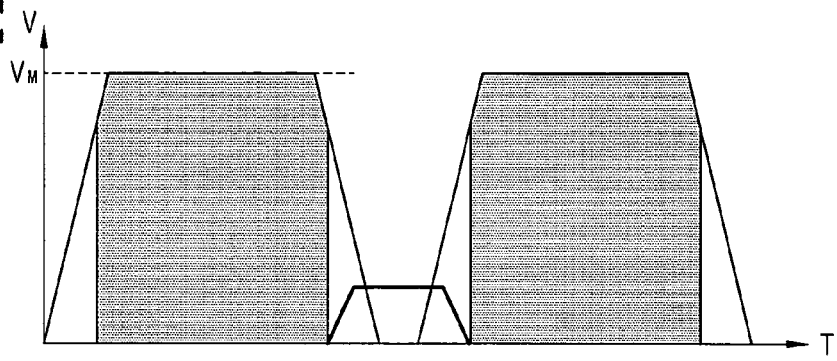
Figure 4F:
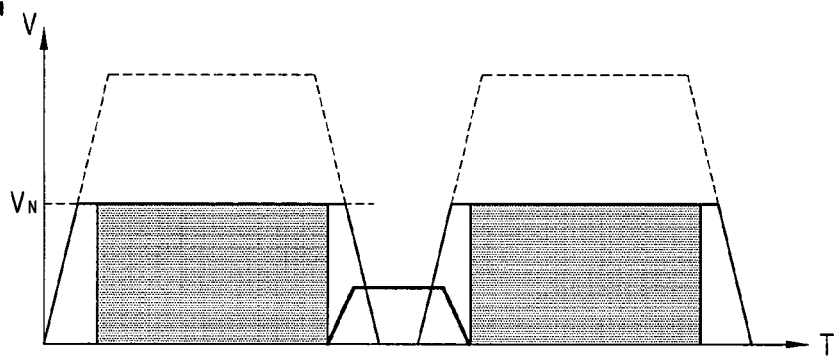
Figure 4G:
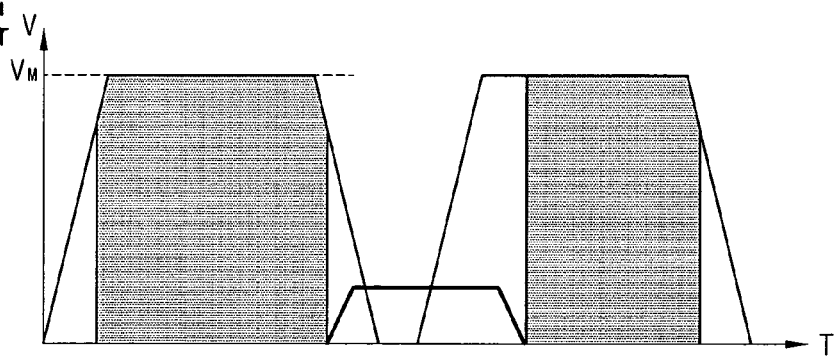
Figure 4H:
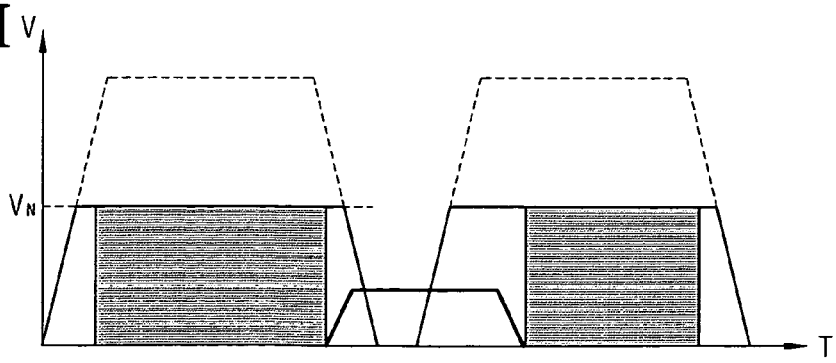

FIGS. 4A and 4B show a line feeding pattern of a very small line feeding distance $D_F$, that appears in a printing operation provided for obtaining a high quality printout product from among several line feeding patterns of a paper P. Because the length of time required for a line feeding is shorter than the length of time from a time point where a line feeding is completed while the carrier is moving, to a time point where the carrier 20 is stopped as shown in FIGS. 4A and 4D, the carrier 20 can start to move for the next line printing immediately after the carrier is stopped from the previous line printing.

If the length of time required for a line feeding is longer than the length of time from a time point where a line feeding is completed while the carrier is moving, to a time point where the carrier 20 (FIG. 1) is stopped as shown in FIGS. 4E to 4H, the carrier 20 should be controlled so that the movement of the carrier 20 is initiated while a line feeding of a paper is performed in order to reduce the length of time required for printing. If the carrier 20 waits, and starts to move for the next line printing after a line feeding is completed as in conventional processes, a time delay can occur since the next line printing is initiated after the line feeding is completed and a length of time passes.

It should be noted that if the ink is ejected from the ink cartridges 11 and 12, and thus the line printing is initiated in the course of feeding a paper P without finishing the line feeding of the paper P, an inferior printing can result. Therefore, the line printing should preferably be initiated after the line feeding of a paper P is completed, while an overlap in time can occur between the line feeding of the paper P and the movement of the carrier 20. For that purpose, as shown in FIG. 4A, an estimate is required for an expected length of time $T_E$ from a time point $T_C$ where the carrier 20 starts to move for the next line printing, to a time point $T_I$ where the next line printing is initiated.

Hereinbelow, methods for estimating the expected length of time $T_E$, and controlling the movement of the carrier 20 and the line feeding of a paper P, are described in accordance with an embodiment of the present invention. The method provides a movement of each so that an overlap in time takes place between the movement of the carrier 20 and the line feeding of the paper P on the basis of the estimation, as illustrated in FIGS. 5 to 9.

Figure 5A:
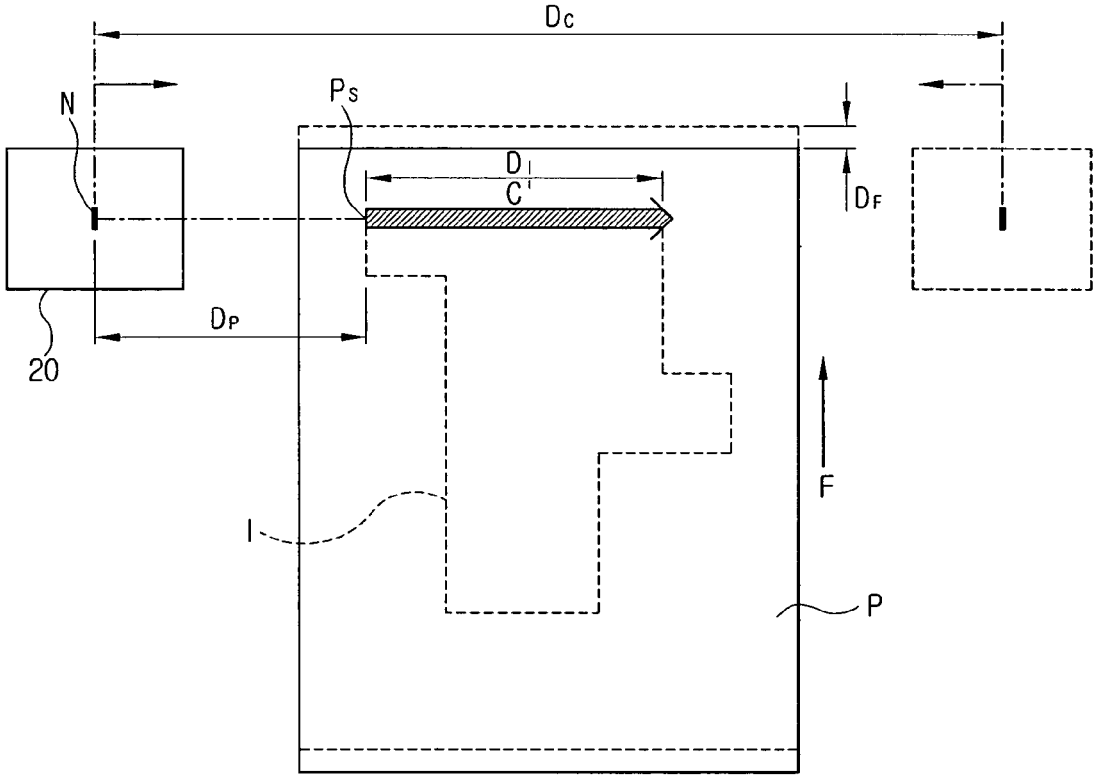
FIGS. 5A and 5B are views provided to describe the operation of an example inkjet printer including the printing control method according to an embodiment of the present invention.
Figure 5B:
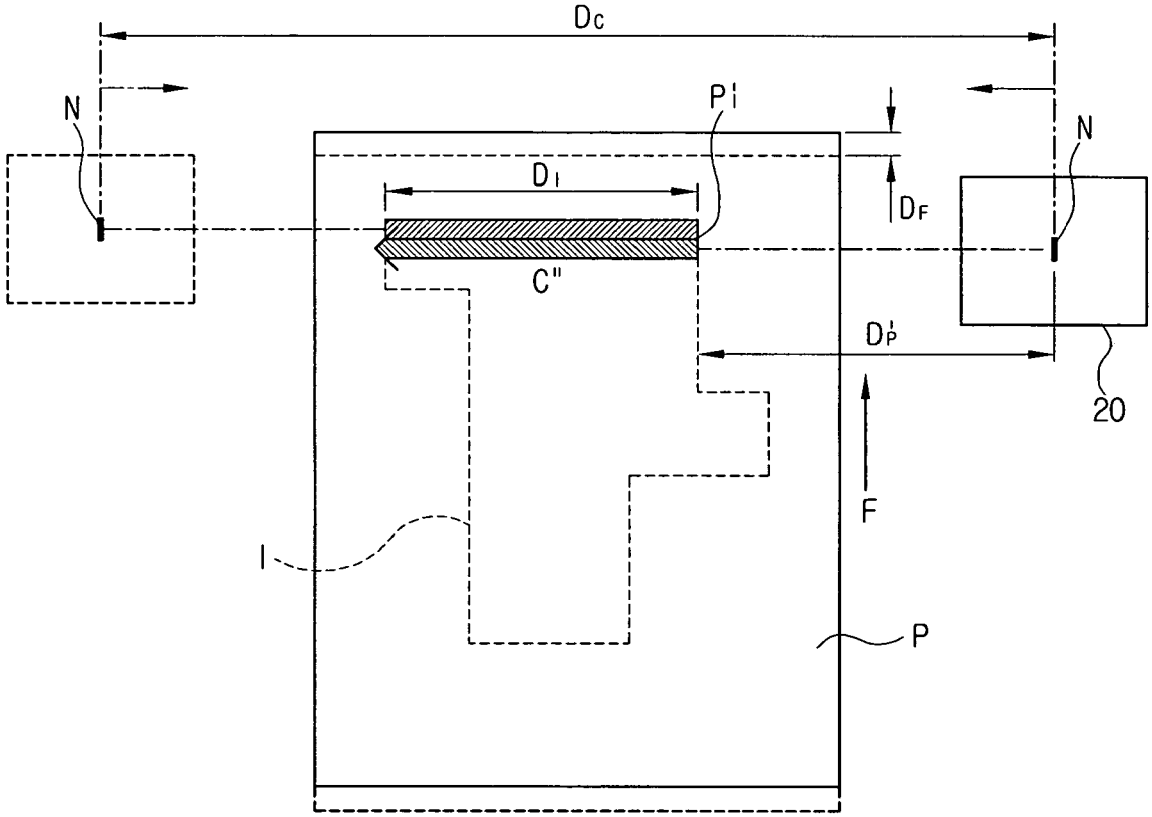

As shown in FIGS. 5A and 5B, which illustrate paths of operation as directed by the embodiment of the present invention, the ink cartridges 11 and 12 (FIG. 1) reciprocate within a carrier moving distance $D_C$, and the line feeding of a paper P is performed in the direction perpendicular to the moving direction of the carrier 20. When the paper P is positioned in the printing position and the inkjet printer receives a printing command $C_P$ (FIG. 3), the carrier 20 is moved in the printing direction C' toward an image area I on the paper P. Then, ejection of the ink is initiated at a distance $D_P$ from the ink ejection point N of the ink cartridges 11 and 12 equipped in the carrier 20 as the carrier reaches an initial point $P_S$ of the image area I. Accordingly, a line printing for the line printing distance $D_I$ is executed over the path C'.

Figure 9:
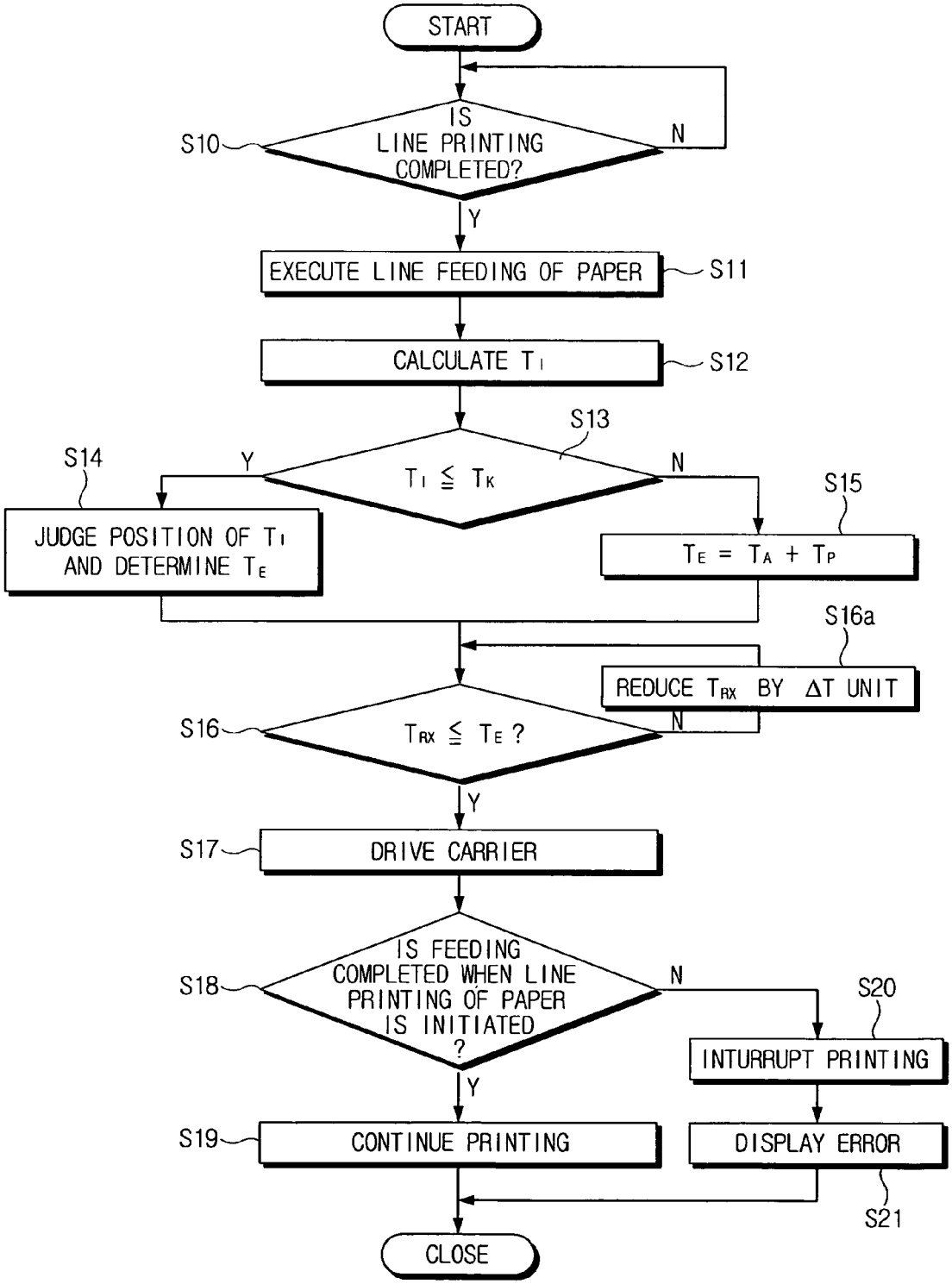
FIG. 9 is a control flowchart illustrating an example of the printing control method according to an embodiment of the present invention.

The control method resulting in the paths of operation of FIGS. 5A and 5B are outlined in the flow chart of FIG. 9. At this time and referring to the flow chart, the controller 60 (FIG. 3) determines whether the line printing has been completed at step (S10) (FIG. 9), and then allows a line feeding of the paper P to be executed at step (S11) if the line printing has been completed. The line feeding of the paper P is executed as the controller 60 receives a feeding command $C_F$ and controls the feeding roller driving device 45 (FIG. 3).

Figure 6:
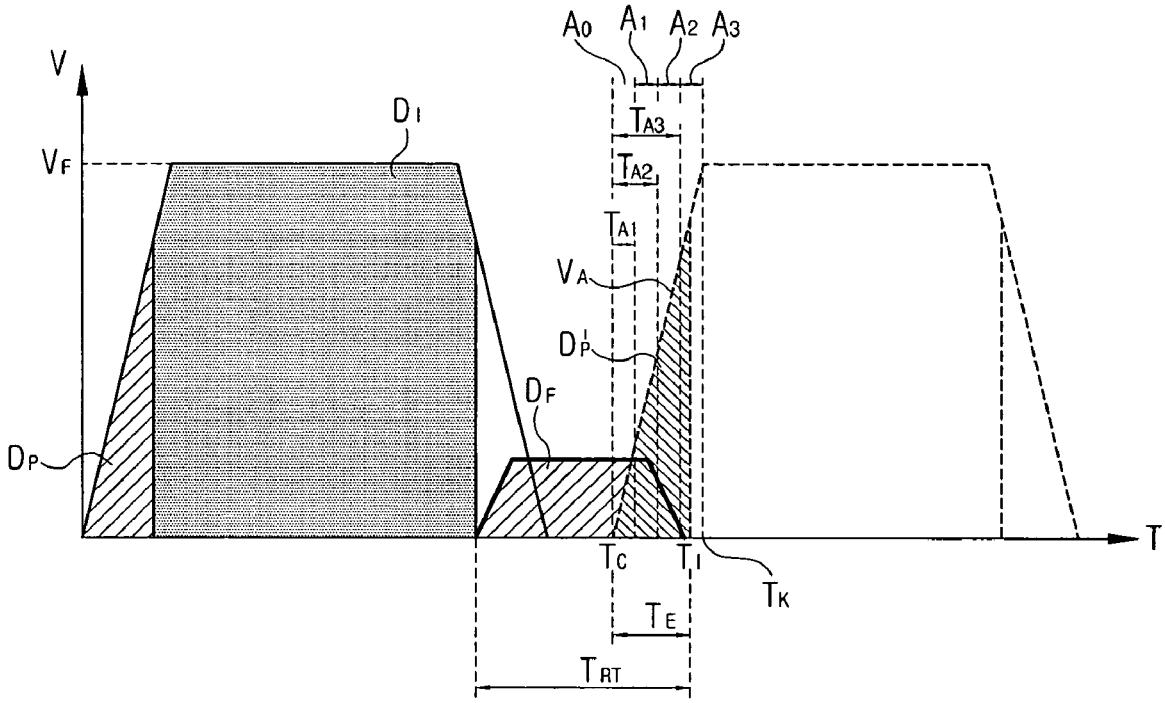
FIGS. 6 to 8 are graphs illustrating the relationships between the movement of the carrier and paper feeding movements to describe the printing control method according to an embodiment of the present invention.

As shown in FIG. 5A, the carrier 20 has moved in the printing direction C' and stopped at the opposite side of the image area I. Before the carrier is moved for the next line printing, the host 100 (FIG. 3) sends a next printing command $C_P$ to the controller 60 (FIG. 3). From this next printing command $C_P$, the controller 60 calculates the distance $D_P'$ (FIG. 5B) from an ink ejection point N to the initiating point $P_I'$ (FIG. 5B) of the next line printing, and the time point $T_I$ (FIG. 6) where the next line printing is to be initiated at step (S12) (FIG. 9). Next, the controller 60 estimates an expected length of time $T_E$ from the time point $T_C$, where the carrier 20 starts to move, to the time point $T_I$, where the next line printing is initiated, as shown in FIG. 6. The method for estimating the expected length of time $T_E$ can be varied according to whether the time $T_I$ is positioned in the acceleration section $V_A$ or in the constant-velocity section $V_P$ in the moving velocity section of the carrier 20. Therefore, upon calculating the $T_I$, the controller 60 determines whether the time $T_I$ is ahead of or behind the time point $T_K$ where the constant-velocity $V_P$ is initiated at step (S13) (FIG. 9).

As shown in FIG. 6, the time $T_I$ is positioned in the acceleration section $V_A$ and the time $T_E$ is determined by a value corresponding to a unit acceleration section, where the time $T_I$ is positioned among four unit acceleration sections $A_0$ to $A_3$ of the acceleration section $V_A$ in step (S14) (FIG. 9). The unit acceleration sections are determined by dividing the length of time from the time point $T_C$ where the carrier 20 starts to move, and the time point $T_K$ where the carrier constant-velocity section $V_P$ is initiated, by a predetermined interval. In this example embodiment of the present invention, the times $T_E$ in respective unit acceleration sections are previously established. The times $T_E$ corresponding to the respective unit acceleration sections $A_0$ to $A_3$ are intervals from the time point $T_C$ where the carrier 20 starts to move, to the respective time points where the unit acceleration sections are initiated, respectively. As shown in FIG. 6, the time $T_E$ in the section $A_0$ is 0, the time $T_E$ in the section $A_1$ is $T_{A1}$, the time $T_E$ in the section $A_2$ is $T_{A2}$, and the time $T_E$ in the section $A_3$ is $T_{A3}$. Therefore, if the time $T_I$ is positioned in the $A_3$ section, the time $T_E$ will be $T_{A3}$. The embodiments of the present invention are not limited to these unit acceleration sections of four intervals and, as the interval of each unit acceleration section is reduced or the number of unit acceleration sections are increased, time $T_E$ can be obtained more precisely.

Figure 7:
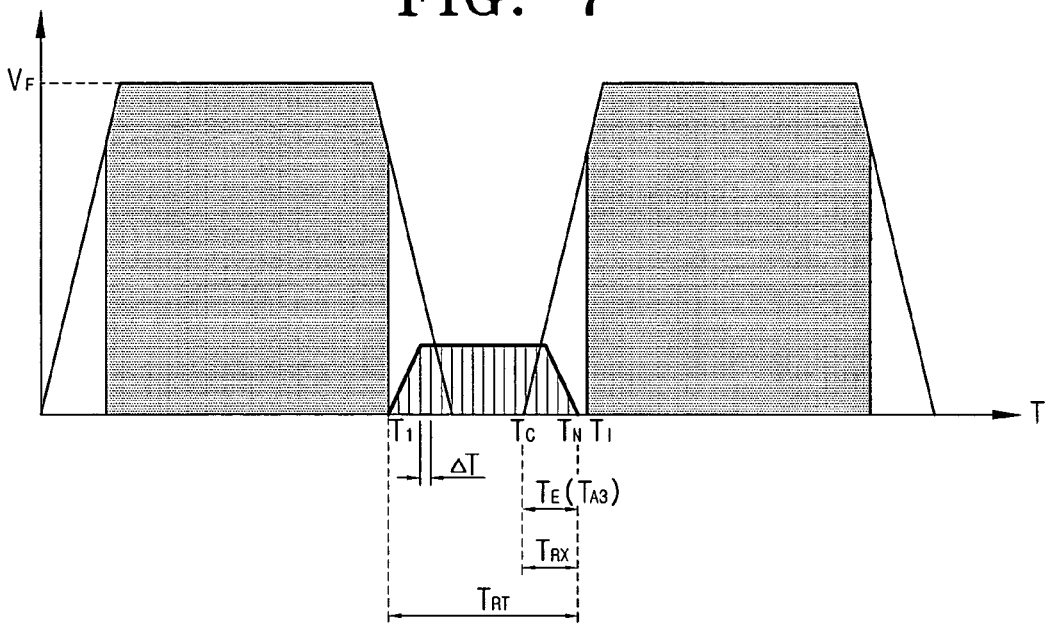

If the time $T_E$ is estimated in this manner, the controller 60 (FIG. 3) then compares the length of the remaining feeding time $T_{RX}$, the time until the line feeding of the paper is completed, with the time $T_E$ at step (S16) (FIG. 9), to locate a time point where the time $T_{RX}$ becomes equal to or less than the time $T_E$. The time $T_{RX}$ being equal to or less than the time $T_E$ provides that the line printing is not initiated until a line feeding of a paper is completed, even if the carrier 20 starts to move. Therefore, the controller 60 drives the carrier 20 at a time point where the time $T_{RX}$ becomes equal to or less than the time $T_E$ at step (S60), as shown in FIG. 7. Accordingly, the line feeding of the paper P and the movement of the carrier 20 take place with an overlap in time $T_{A3}$. The length of remaining feeding time $T_{RX}$ is determined by dividing a total feeding time $T_{RT}$ by $\Delta T$ into N sections, wherein the total feeding time $T_{RT}$ is about 100 ms to about 200 ms, and the $\Delta T$ is about 2 ms. Therefore, the remaining feeding time $T_{RX}$ is compared with the time $T_E$ at an interval of 2 ms at step (S16*a*) (FIG. 9). As the size of $\Delta T$ is made smaller, the control precision becomes larger, therefore, the $\Delta T$ may have various values, such as anywhere between 1 ms and 4 ms.

Figure 8:
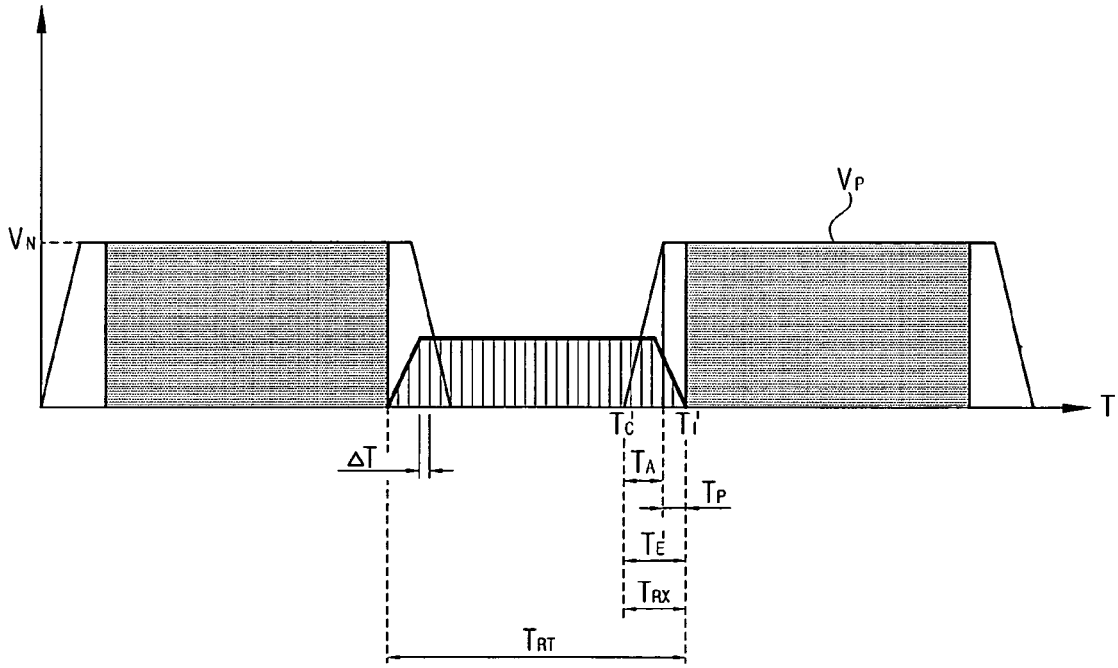

FIG. 8 illustrates a time $T_E$ calculating and printing control method in accordance with an embodiment of the present invention, when the time point $T_I'$, where a line printing is initiated, is positioned in the constant-velocity section $V_p$. Based on a printing command $C_P$ sent from the host 100 (FIG. 3), the controller 60 (FIG. 3) estimates if the time point $T_I'$, where a line printing is initiated, will be positioned in the constant-velocity section $V_P$. The controller 60 calculates a length of time $T_E'$ required from the time point $T_C'$, where the carrier 20 starts to move, to the time point $T_I'$, where the line printing is initiated. The controller 60 calculates the length of time $T_E'$ by summing a total length of time $T_A$ required for the acceleration section $V_A$, with a length of time $T_P$ required from the time point $T_K'$, where the constant-velocity section is initiated, to the time point $T_I'$, where the line printing is initiated at step (S15) (FIG. 9). While a line feeding of the paper P is being executed, the controller 60 compares the length of remaining feeding time $T_{RX}'$ until the line feeding of the paper P is completed, with the time $T_E'$ at an interval of $\Delta T$, thereby finding a time point where the time $T_{RX}'$ becomes equal to or less than the time $T_E'$ at step (S16) (FIG. 9). At the time point where the time $T_{RX}'$ becomes equal to or less than the time $T_E'$ at step (S16), the controller 60 drives the carrier 20 for the next line printing by controlling the carrier driving device 25 (FIG. 3) at step (S17) (FIG. 9). Therefore, the carrier 20 starts to move while the line feeding of the paper P is being executed, and the ink is ejected from the ink cartridges 11 and 12. Accordingly, a line printing is initiated substantially concurrently with the completion of the line feeding of the paper P. As a result, the time delay which occurs from the time point where a line feeding of the paper P is completed, to the time point where a line printing is initiated, is reduced.

Depending on the circumstances of the movement of the carrier 20 and the line feeding of a paper P, the time point where a line feeding is completed or the time point where the ink ejection is initiated may be beyond expected values. Since inferior printing may be caused if the line printing is initiated before the line feeding is completed, an error under these conditions should be detected at an early stage.

For that purpose, the embodiments of the present invention can detect such an error with additional steps provided by the method of FIG. 9. When the line printing is initiated, the controller 60 (FIG. 3) receives information on the paper feeding from the feeding roller driving device 45 (FIG. 3) and information on the ink ejection from the ink cartridges 11 and 12 (FIG. 3). Then, the controller 60 determines whether the time point where the practical line printing is initiated is ahead of or behind the time point where the line feeding of the paper P is completed at step (S18) (FIG. 9). At that time, if it is determined that the line printing takes place after the line feeding of the paper P has been completed, the controller 60 allows the printing to be continued at step (S19) (FIG. 9). If it is determined that the line feeding takes place before the line feeding of the paper P is completed, the controller 60 interrupts the printing operation at step (S20) (FIG. 9), and indicates this error through the display device at step (S21) (FIG. 9). As the printing operation is interrupted right after the inferior printing occurs as detected above, waste of ink and electric consumption can be reduced.

If a normal printing operation is executed without causing inferior printing, the line feeding of a paper and the line printing by the movement of the carrier 20 according to the control system and method as described above will be repeated until one page printing of the paper P is completed.

As described above, according to the embodiments of the present invention, it is possible to estimate an expected length of time $T_E$ from a time point where the carrier 20 starts to move, to a time point where the next line printing takes place, and to determine a proper time point for moving the carrier 20 on the basis of the expected length of time $T_E$. Therefore, it is possible to realize an inkjet printer that provides a line feeding of the paper P and a movement of the carrier 20 which are overlapped in time. As a result, the printing speed is enhanced.

While the invention has been shown and described with reference to certain preferred embodiments thereof, it will be understood by those skilled in the art that various changes in form and detail may be made therein without departing from the spirit and scope of the invention as defined by the appended claims.

What is claimed is:

1. A printing control method for an inkjet printer, comprising the steps of:

executing a line feeding of a paper;

driving a carrier equipped with a cartridge; and operating the cartridge so that a line printing is executed on the paper, wherein the carrier is driven according to a comparison of a duration of time from a point of initiating the carrier driving to a point of initiating the line printing, and a length of feeding time $T_{RX}$ remaining until the line feeding is completed, to be continuously driven while the line feeding is being executed when a carrier driving period exceeds or equals a line feeding period and the carrier driving is paused when the line feeding period exceeds the carrier driving period, and the line printing is initiated after the line feeding of the paper is completed.

2. The method according to claim 1, further comprising steps of:

determining whether the line printing by the cartridge has been completed;

executing the line feeding if it is determined that the line printing has been completed;

estimating an expected length of time $T_E$ from a time point $T_C$ where the carrier's next movement is initiated, to a time point $T_I$ where the next line printing is initiated;

comparing the $T_{RX}$ with the expected length of time $T_E$; and driving the carrier if the length of the remaining feeding time $T_{RX}$ is less than or equal to the expected length of time $T_E$.

3. The method according to claim 2, wherein:

the moving velocity of the carrier is varied, and the moving velocity of the carrier is further divided into an acceleration section, a constant-velocity section, and a deceleration section, and wherein, the acceleration section is divided into a plurality of unit acceleration sections, and wherein, the expected length of time $T_E$ is determined as a length of time from the time $T_C$ to a time point where a corresponding unit acceleration section is initiated if the time point $T_I$ is positioned in the acceleration section.

4. The method according to claim 3, wherein the plurality of unit acceleration sections are formed by dividing a length of time from the time point $T_I$ to a time point $T_K$ where the constant-velocity section is initiated, by a predetermined time interval.

5. The method according to claim 2, wherein in the step of comparing the time $T_{RX}$ with the time $T_E$, the time $T_{RX}$ is reduced and compared with the time $T_E$ at an interval of a predetermined time $\Delta T$.

6. The method according to claim 2, further comprising steps of:

determining whether the line feeding of the paper has been completed at a time point where the next line printing is initiated; and displaying an error message if it is determined that the line printing has been initiated in a state where the line feeding of the paper has not been completed.

7. The method according to claim 1, wherein the line feeding of the paper for the next line printing is initiated substantially concurrent with the completion of the line printing.

8. The method according to claim 1, wherein the cartridge comprises at least one ink cartridge.

9. A printing control system for an inkjet printer, comprising:

at least one cartridge;

a carrier, having a means to secure the cartridge and perform a line printing;

a feeding roller, to execute a line feeding of a paper and transfer the paper into a print area;

a feeding roller, driving device in communication with the feeding roller;

a carrier driving device, having a means to drive the carrier across the paper in the print area; and a controller, in communication with the feeding roller driving device and the carrier driving device, the controller directing the carrier driving device according to a comparison of a duration of time from a point of initiating the carrier driving to a point of initiating the line printing, and a length of feeding time $T_{RX}$ remaining until the line feeding is completed, to be continuously driven while the line feeding is being executed when a carrier driving period exceeds or equals a line feeding period and the carrier driving is paused when the line feeding period exceeds the carrier driving period, and wherein the line printing is initiated after the line feeding of the paper is completed.

10. The printing control system for an inkjet printer according to claim 9, wherein the cartridge comprises at least one ink cartridge.

11. A printing control method for an inkjet printer, comprising the steps of:

executing a line feeding of a paper;

driving a carrier equipped with a cartridge;

operating the cartridge so that a line printing is executed on the paper, wherein the carrier is driven while the line feeding is being executed, and the line printing is initiated after the line feeding of the paper is completed;

determining whether the line printing by the cartridge has been completed;

executing the line feeding if it is determined that the line printing has been completed;

estimating an expected length of time $T_E$ from a time point $T_C$ where the carrier's next movement is initiated, to a time point $T_I$ where the next line printing is initiated;

comparing a length of feeding time $T_{RX}$ remaining until the line feeding is completed, with the expected length of time $T_E$; and driving the carrier if the length of the remaining feeding time $T_{RX}$ is less than or equal to the expected length of time $T_E$.

12. The method according to claim 11, wherein:

the moving velocity of the carrier is varied, and the moving velocity of the carrier is further divided into an acceleration section, a constant-velocity section, and a deceleration section, and wherein, the acceleration section is divided into a plurality of unit acceleration sections, and wherein, the expected length of time $T_E$ is determined as a length of time from the time $T_C$ to a time point where a corresponding unit acceleration section is initiated if the time point $T_I$ is positioned in the acceleration section.

13. The method according to claim 12, wherein the plurality of unit acceleration sections are formed by dividing a length of time from the time point $T_I$ to a time point $T_K$ where the constant-velocity section is initiated, by a predetermined time interval.

14. The method according to claim 11, wherein in the step of comparing the time $T_{RX}$ with the time $T_E$, the time $T_{RX}$ is reduced and compared with the time $T_E$ at an interval of a predetermined time $\Delta T$.

15. The method according to claim 11, further comprising steps of:

determining whether the line feeding of the paper has been completed at a time point where the next line printing is initiated; and displaying an error message if it is determined that the line printing has been initiated in a state where the line feeding of the paper has not been completed.

16. The method according to claim 11, wherein the line feeding of the paper for the next line printing is initiated substantially concurrent with the completion of the line printing.

17. The method according to claim 11, wherein the cartridge comprises at least one ink cartridge.

* * * * *